US005443206A

United States Patent [19]

Cohen

[11] Patent Number: 5,443,206

[45] Date of Patent: Aug. 22, 1995

[54] STANDBY LOSS MINIMIZING CONTROLLER FOR BOILERS WITH TANKLESS WATER HEATERS

[76] Inventor: Isaac Cohen, 1171 Carll's Straight Path, Dix Hills, N.Y. 11746

[21] Appl. No.: 278,793

[22] Filed: Jul. 21, 1994

[51] Int. Cl.[6] ..... F23N 1/08; F24D 3/00

[52] U.S. Cl. ..... 236/20 R; 236/46 R; 237/8 R

[58] Field of Search ..... 236/46 R, 20 R, 78 D; 219/492; 237/8 R

[56] References Cited

U.S. PATENT DOCUMENTS

| | | | |
|---|---|---|---|
| 3,989,928 | 11/1976 | Scragg et al. | 236/46 R |
| 4,508,261 | 4/1985 | Blank | 236/20 R |
| 4,564,141 | 1/1986 | Montgomery et al. | 236/46 R |

*Primary Examiner*—William E. Wayner

[57] ABSTRACT

A boiler controller for hydronic heating systems that reduces the standby heat losses from boiler to a minimum and activates the boiler automatically when hot water or/and space heating demand are present.

6 Claims, 3 Drawing Sheets

FIGURE 1 – PRIOR ART

STANDBY LOSS MINIMIZING CONTROLLER FOR BOILERS WITH TANKLESS WATER HEATERS

BACKGROUND OF THE INVENTION

This invention relates to temperature control of boilers for hydronic heating systems equipped with tankless water heaters.

Typically, the operation of these boilers is controlled by a thermostat that turns the burner on when the boiler's internal temperature drops below a "LOW" value and turns it off when the temperature exceeds a "HIGH" value, thereby maintaining the temperature of the boiler at a constant average value.

These boilers also supply the domestic hot water and therefore have to be in operation even when no space heating is required. In the majority of cases residential use of hot water is limited to few short intervals during each 24 hour period, therefore maintaining the boiler at an elevated temperature around the clock will cause a significant standby heat loss during the warm seasons.

Since during the warm seasons the boiler can be turned off when no hot water demand is present, the standby, loss is some times reduced by using a programmable timer to turn the boiler off during the time periods when no hot water demand is anticipated.

As shown in FIG. 1, a programmable timer is programmed to turn switch 2 whenever hot water demand is anticipated and to keep it on for the expected duration of the demand. Switch 2 controls the power going to thermostat 3 and allows the burner of the boiler 4 to operate only for the duration of the programmed periods.

This method is simple and inexpensive, but has the disadvantage of requiring frequent reprogramming as the seasons change and the time during which the boiler has to provide space heat gradually increases or decreases. In addition, the accommodation of unscheduled hot water demands will also require temporary reprogramming or bypassing of the timer.

It is therefore the object of the invention to provide a controller for boilers that will minimize the standby heat loss and will automatically adjust the time periods during which the boiler is operated so both unscheduled hot water demands and seasons change are accommodate without reprogramming.

DETAILED DESCRIPTION OF THE PREFERRED EMBODIMENTS

Figure 1:
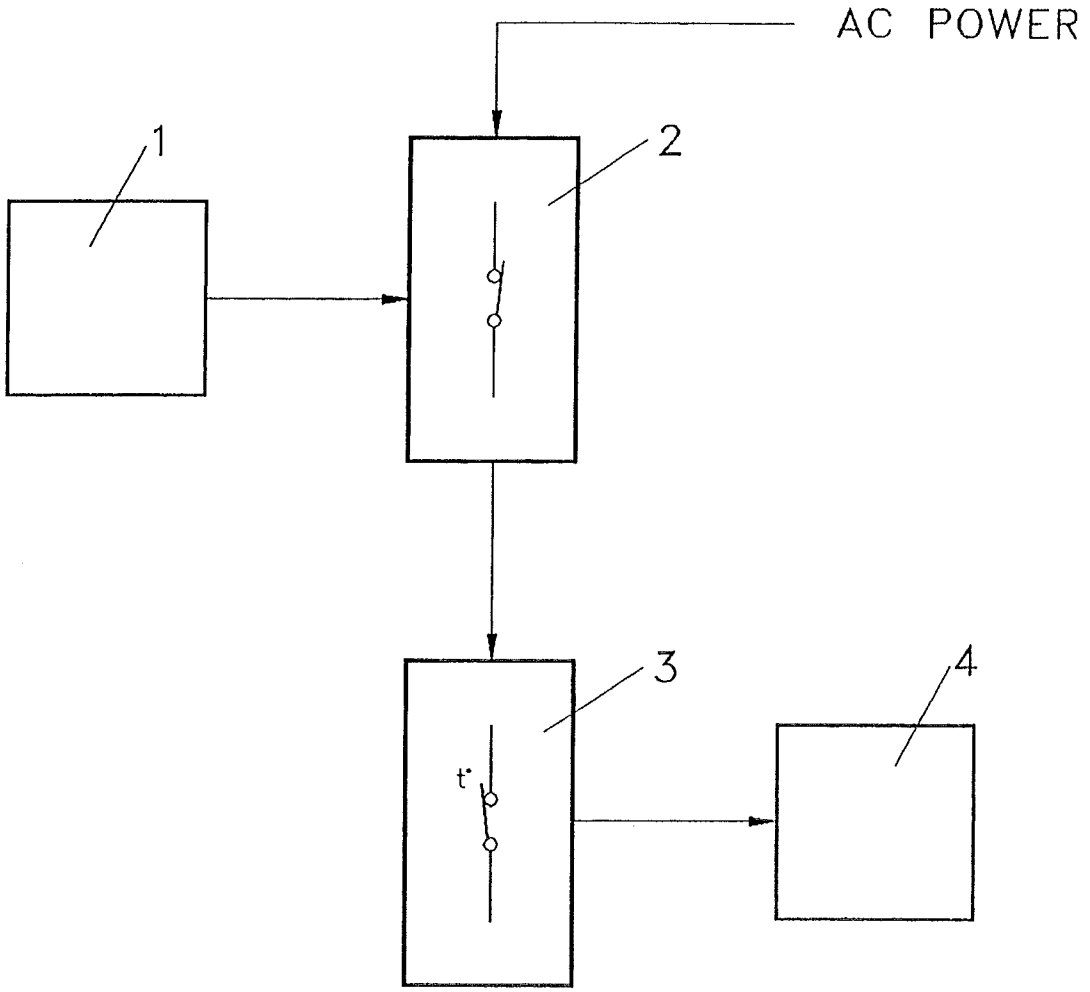
FIG. 1 shows a block diagram of a boiler control of the prior art that includes a programmable timer.
Figure 2:
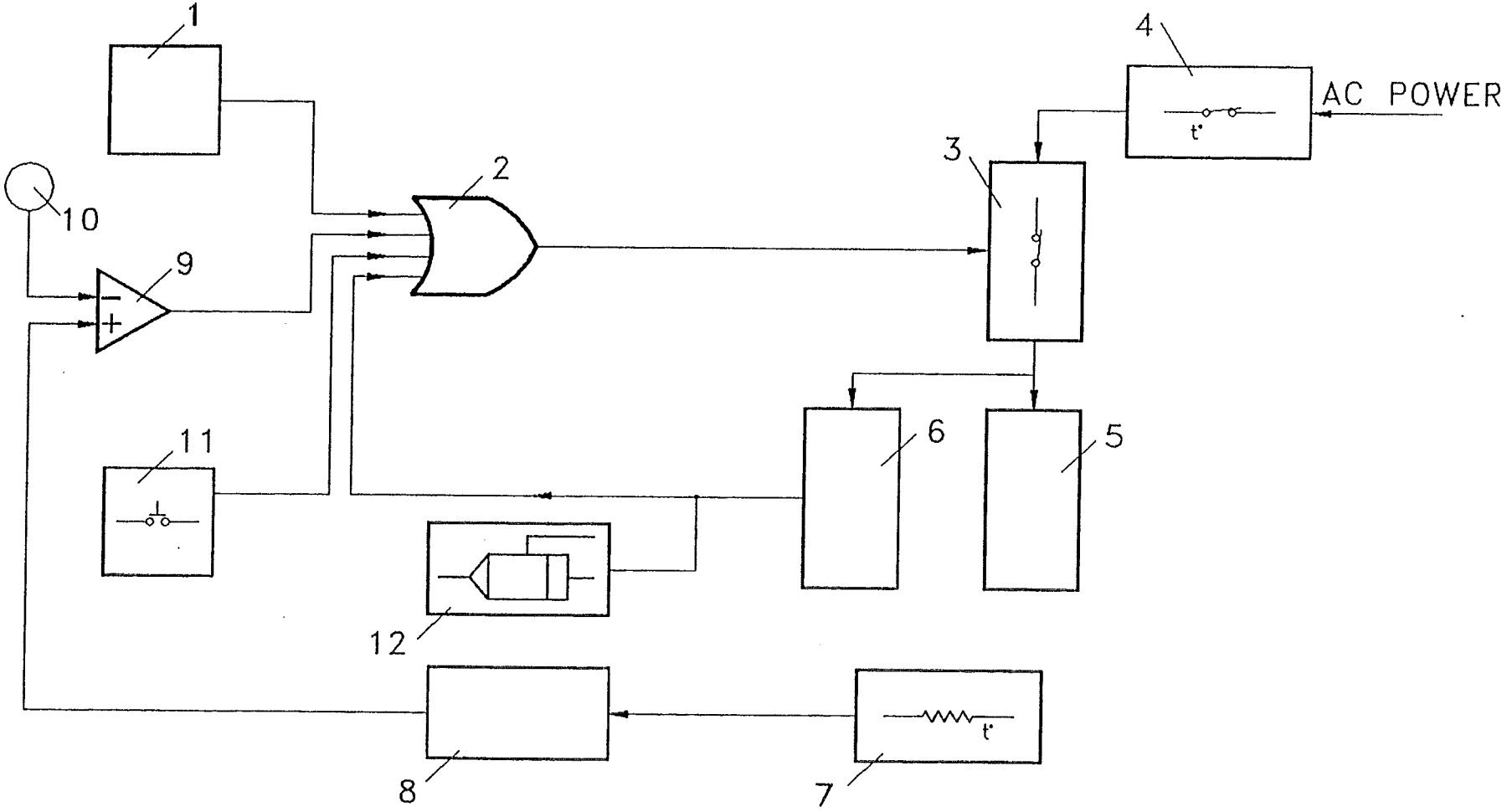
FIG. 2 shows a block diagram of one embodiment of the invention.

Referring to FIG. 2, the programmable clock 1 delivers a momentary "TRUE" pulse to an input of the OR gate 2 a few minutes before the expected demand of hot water. Upon application of the pulse, the output of the OR gate 2 assumes a "TRUE" value and turns "on" switch 3, thereby applying power coming from the thermostat 4 to the burner 5, causing the burner to fire if the internal boiler temperature is lower than the "LOW" temperature setting of its thermostat.

Voltage detector 6 senses the presence of voltage at the output of switch 3 and generates a "TRUE" signal for as long as this voltage is present. This signal is fed to a second input of OR gate 2, effectively latching switch 3 in an "ON" condition.

With the burner operating, the boilers temperature will eventually exceed the "HIGH" setting of 1 thermostat 4, and the thermostat will disconnect the power from switch 3. As a result, the voltage at the output of switch 3 will disappear and the signal at the output of sensor 6 will assume a "FALSE" value, causing the OR gate 2 to release switch 3. If the anticipated hot water demand does not materialize, the boiler will return to a standby mode after a single burn and will not turn on even if its temperature drops below the "LOW" setting of its thermostat. If the demand does happen, it may appear while the burner is still operating or after it has turned off. In the first case, the thermal load will simply extend the duration of the bum. In the second case, the thermal load will cause a rapid drop in the boiler's temperature. This temperature is sensed by the temperature sensor 7 and its derivative is calculated by differentiator 8.

Comparator 9 compares the value of the derivative to the rate reference 10 and provides a "TRUE" value to a third input of the "OR" gate 2 when the cooling rate of the boiler is fast, thereby causing the output of gate 2 to stay high for as long as the fast cooling of the boiler continues.

The invention takes advantage of the fact that when the boiler delivers hot water or provides space heating its cooling rate is at least an order of magnitude faster than the cooling rate due to only the standby losses. This fact facilitates discrimination between the cooling rates and allows the use of low accuracy (and therefore low cost) devices and circuits for the temperature sensor 7, differentiator 8, reference 10 and comparator 9.

It should be noted that as opposed to the prior art, the programmable timer 1 does not determine the duration of the time for which the boiler will operate; its function is to guarantee that the boiler's temperature is above the "LOW" setting of the thermostat just before the hot water delivery is about to begin.

Indeed, if it is known that the boiler temperature does not drop excessively between two consecutive hot water demand periods, timer 1 can be eliminated altogether and the operation of the boiler can be initiated by the manual momentary switch 11.

This switch provides a "TRUE" input to gate 2 when manually activated and can be used to start up a cold boiler or to bring the boiler to high temperature immediately before drawing hot water.

The sequences described above show clearly that as long as the boiler temperature is higher than the temperature of its intake water, drawing hot water from the boiler (or having the boiler provide space heat will initiate a virtually immediate activation of the burner, providing the controller with the desired capability to respond to unscheduled hot water demands or to operate continuously whenever space heat is required while keeping the burner operating time at an absolute minimum when no demand for either hot water or space heat is present, thereby achieving the objectives of the invention.

The fact that voltage sensor 6 provides a "TRUE" signal of a duration equal to the time the burner is operating creates the opportunity to conveniently measure the cumulative fuel consumption of the boiler. Since when in operation burners consume fuel at a rate that is essentially constant, the integration of the specific fuel consumption rate of the burner over its operating time yields the cumulative fuel consumption of the boiler.

This function is represented by the integrator 12 whose output can be used to generate and display a variety of statistics related to the fuel consumption of the boiler.

In some cases, such as when retrofitting existing boilers with a standby loss minimizing controller it may not be convenient to install a temperature sensing element on the boiler so in such cases a simpler controller may be appropriate.

Figure 3:
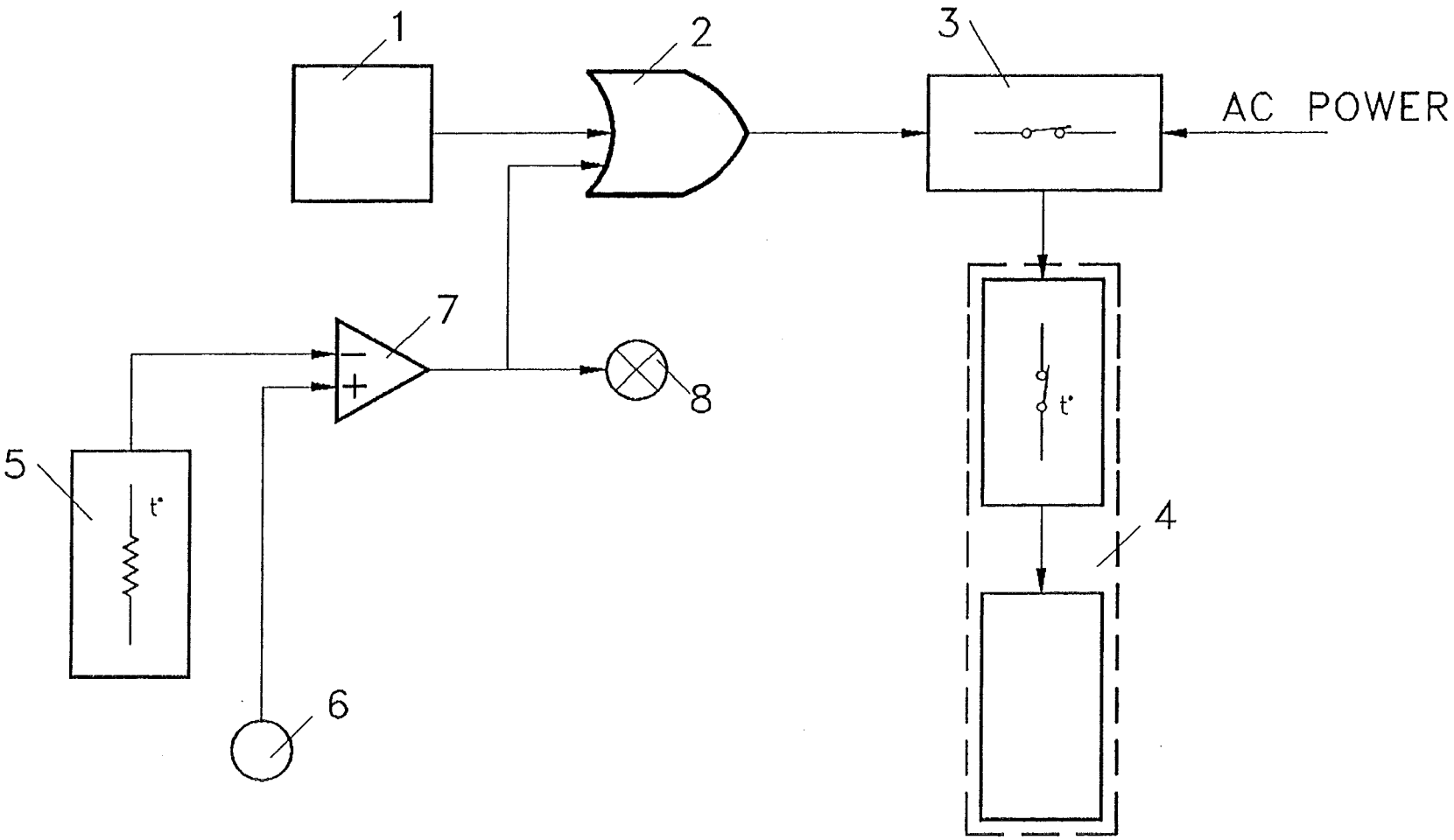
FIG. 3 shows the block diagram of another embodiment of the invention.

Referring to FIG. 3, programmable timer 1 provides a "TRUE" signal to one input of OR gate 2 whenever a hot water demand is expected, the duration of this signal being equal to the anticipated duration of the demand. The output of gate 2 assumes a "TRUE" value and turns on switch 3, keeping boiler 4 in operation for the programmed duration.

To eliminate the need for seasonal reprogramming associated with the prior art, the present invention uses the temperature sensor 5 for sensing the temperature at an unheated or indirectly heated location (such as a garage, basement, etc.) within the structure served by the boiler. The temperatures at such locations are strongly influenced by the outdoor temperature and therefore can provide an indication of the need for space heat.

The output of sensor 5 is compared to temperature reference 6 by comparator 7 that generates a "TRUE" signal if reference 6 is higher than the output of sensor 5 and the output of comparator is applied to a second input of OR gate 2, which will keep switch 3 on for as long as the "TRUE" signal persists.

When the outdoor temperature drops and the user of the boiler want to start the heating season he will adjust reference 6 until indicator 8 shows that the output of comparator 7 is "TRUE". By doing so, the user selects the temperature below which the boiler will be permanently in operation. When the outdoor temperature will increase again, the temperature at the location of sensor 5 will also increase and will cause its output to exceed the value of reference 6 and the boiler will operate again only during the periods programmed into timer 1.

It must be emphasized that neither sensor 5 or reference 6 have to be accurate or highly repeatable in characteristics from unit to unit, since each controller will be in effect calibrated individually by the user. For the same reason, it is not necessary to know the exact relationship between the temperature at the location of sensor 5 and the outdoor temperature; it is 16 enough that the temperature sensed by sensor 5 is influenced by the outdoor temperature. These properties of the control method of this invention allow for embodiments based on very inexpensive components and manufacturing processes.

Finally, it should be noted that all the functional blocks used in this invention (switches, logic gates, temperature sensors, comparators, voltage sensing devices and differentiators) are common knowledge in the art and those versed in it will be able to implement any of them using well-established analog or digital techniques.

What is claimed is:

1. A standby loss minimizing controller for a boiler with a temperature control system consisting of a burner circuit connected to a voltage source thorough a boiler thermostat, the said controller comprising:

a programmable clock to provide a first logic signal that is "TRUE" only for a short duration at several programmed times each day;

a temperature sensing means for generating a temperature signal proportional to the internal temperature of the said boiler;

a differentiating means responsive to the said temperature signal to generate a cooling rate signal proportional to the cooling rate of the boiler;

a source to provide a cooling rate reference signal, of a magnitude that is selected to represent the cooling rate of the boiler caused by standby heat losses from the boiler, the said cooling rate being a measurable characteristic of the said boiler;

a comparator means responsive to the said cooling rate signal and said cooling rate reference to produce a second logic signal that is "TRUE" only when the magnitude of the said cooling rate signal exceeds the magnitude of the said cooling rate reference;

means to manually generate a third logic signal that is "TRUE" for a predetermined duration, the said third logic signal being used by the user of the said boiler to initiate said boiler operation;

a switch means connected in series with the said thermostat in between the said thermostat and the said burner circuit;

a voltage sensing means to generate a fourth logic signal that is "TRUE" when voltage is present across the said burner circuit is present;

a multiple input logic "OR" gate means responsive to the four said logic signals to turn "ON" the said switch means if at least one of the said logic signals is "TRUE";

2. A standby loss minimizing controller of claim 1 wherein the said fourth logic signal is used to activate an integrator means to calculate the time integral of a constant over the time interval during which the said forth logic signal is "TRUE", the said constant being proportional to the fuel consumption rate of the said boiler, thereby providing the means to measure the cumulative fuel consumption of the said boiler.

3. The controller of claim 1 wherein the user of the said boiler programs the said programmable timer.

4. A standby loss minimizing controller for the boiler of claim 1, consisting of:

a programmable timer to generate a first logic "TRUE" signal of programmed duration at programmed times;

a temperature sensing means to generate a temperature signal proportional to the temperature at a location inside the structure served by the said boiler, the said location being in an unheated section of the structure;

a source to provide an adjustable temperature reference:

a comparator means to generate a second logic "TRUE" signal if the value of the said temperature reference is higher than the value of the said temperature signal;

an indicator means responsive to the said second logic signal to provide a visual indication when the said second logic signal is "TRUE";

a switch means in series with the said thermostat;

an OR gate to turn on the said switch means if any of the two said logic signals are true.

5. The controller of claim 4 wherein the value of the said temperature reference is adjusted by the user of the boiler to a value that will cause the said second logic signal to assume a "TRUE" value.

6. The controller of claim 4 wherein the user of the boiler programs the said programmable timer.

* * * * *